US007574120B2

(12) United States Patent
Patterson et al.

(10) Patent No.: US 7,574,120 B2
(45) Date of Patent: Aug. 11, 2009

(54) SYSTEM AND METHOD FOR ESTIMATING AND INDICATING TEMPERATURE CHARACTERISTICS OF TEMPERATURE CONTROLLED LIQUIDS

(75) Inventors: Wade C. Patterson, Huntsville, AL (US); Terry G. Phillips, Meridianville, AL (US)

(73) Assignee: A. O. Smith Corporation, Milwaukee, WI (US)

( * ) Notice: Subject to any disclaimer, the term of this patent is extended or adjusted under 35 U.S.C. 154(b) by 394 days.

(21) Appl. No.: 11/432,103

(22) Filed: May 11, 2006

(65) Prior Publication Data

US 2006/0257127 A1 Nov. 16, 2006

Related U.S. Application Data

(60) Provisional application No. 60/679,762, filed on May 11, 2005.

(51) Int. Cl.
*A47J 27/00* (2006.01)

(52) U.S. Cl. ..... 392/441; 392/447

(58) Field of Classification Search ..... 392/441
See application file for complete search history.

(56) References Cited

U.S. PATENT DOCUMENTS 4,421,269 A 12/1983 Ts'ao
4,620,667 A * 11/1986 Vandermeyden et al. .. 236/20 R
5,056,712 A * 10/1991 Enck ..... 236/20 R
5,103,078 A * 4/1992 Boykin et al. ..... 219/494
6,293,471 B1 * 9/2001 Stettin et al. ..... 236/20 R
6,308,009 B1 * 10/2001 Shellenberger et al. ..... 392/454
RE37,745 E * 6/2002 Brandt et al. ..... 122/14.2
6,633,726 B2 * 10/2003 Bradenbaugh ..... 392/463
2004/0158361 A1 * 8/2004 Patterson et al. ..... 700/299

FOREIGN PATENT DOCUMENTS

WO WO03044610 A1 5/2003

* cited by examiner

*Primary Examiner*—Thor S Campbell
(74) *Attorney, Agent, or Firm*—Michael Best & Friedrich LLP

(57) ABSTRACT

Embodiments of the present disclosure generally pertain to systems and methods for estimating and indicating temperature characteristics of temperature controlled liquids. A system in accordance with one exemplary embodiment of the present disclosure has a tank filled at least partially with a liquid, such as water, and the system has a plurality of temperature sensors mounted on the tank. During operation, a controller compares temperatures sensed by these temperature sensors to a predefined temperature profile for the liquid within the tank in order to estimate the likely temperature characteristics of such liquid. The controller then reports these estimated temperature characteristics via a user interface. As an example, the controller may estimate and report the amount of liquid above a threshold temperature that can be drawn from the tank. Based on the reported temperature characteristics, a user may make decisions about whether or how to use liquid drawn from the tank.

15 Claims, 5 Drawing Sheets

76

| Entry ID | $T_{127}$ | $\Delta T_{127}$ | $T_{128}$ | $\Delta T_{128}$ | E |
|---|---|---|---|---|---|
| 1 | 105 | 5 | 110 | 6 | 50 % |
| 2 | 117 | 1 | 120 | 1 | 80 % |
| 3 | 95 | 10 | 101 | 11 | 20 % |
| 4 | 196 | 3 | 111 | 3 | 60 % |

SYSTEM AND METHOD FOR ESTIMATING AND INDICATING TEMPERATURE CHARACTERISTICS OF TEMPERATURE CONTROLLED LIQUIDS

CROSS REFERENCE TO RELATED APPLICATION

This application claims priority to U.S. Provisional Application No. 60/679,762, entitled "System and Method for Indicating an Amount of Hot Water within a Water Heater," and filed on May 11, 2005, which is incorporated herein by reference.

RELATED ART

Water heaters are often employed to provide users with heated water, which is drawn from a tank of the water heater and usually dispensed from a dispensing device, such as a faucet, showerhead, or like device, coupled to the water heater. During operation, a water heater normally receives unheated water from a water source, such as a water pipe, and stores the water in a tank prior to the water being delivered to a dispensing device. The water heater includes a controller having a user interface that allows a user to set a desired temperature range for the water being held by the tank. If a sensed temperature of the water within the tank falls below the desired temperature range, then the controller activates at least one heating element for warming the water. When activated, a heating element begins to heat the water within the tank, and the heating element continues to heat the water until the sensed temperature exceeds the desired temperature range.

As water is drawn from the tank and used, unheated water from the water source is drawn into the tank to replenish the tank's water supply. This new water is typically at a much lower temperature than the heated water within the tank causing the average water temperature within the tank to rapidly decrease during times of significant water usage. Although one or more heating elements may be activated due to the decrease in water temperature, there is finite amount of time required to heat the water to its desired range. Indeed, due primarily to significant water usage within a short time period, the average water temperature within the tank may fall low enough during some time periods so that a user is unable to dispense water above a desired temperature. For example, a user taking a shower may be exposed to water at an uncomfortably low temperature due to low temperatures of the water within the tank.

Generally, systems and methods for preventing users from being exposed to water at unexpectedly low temperatures due to significant water usage of a water heater are generally desirable.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Embodiments of the present disclosure generally pertain to systems and methods for estimating and indicating temperature characteristics of temperature controlled liquids. A system in accordance with one exemplary embodiment of the present disclosure has a tank filled at least partially with a liquid, such as water, and the system has a plurality of temperature sensors mounted on the tank. During operation, a controller compares temperatures sensed by these temperature sensors to a predefined temperature profile for the liquid within the tank in order to estimate the likely temperature characteristics of such liquid. The controller then reports these estimated temperature characteristics via a user interface. As an example, the controller may estimate and report the amount of liquid above a threshold temperature that can be drawn from the tank. Based on the reported temperature characteristics, a user may make decisions about whether or how to use liquid drawn from the tank.

As an example, a user about to take a shower with water from the system may elect to postpone the shower if the reported temperature characteristics indicate that there is an insufficient amount of water within the tank above a desired temperature. By waiting, the heating elements of the system may have sufficient time to heat the water to more desirable levels before the user takes his or her shower. Moreover, the user may wait until he or she perceives, based on the reported temperature characteristics, that there is a sufficient amount of water above a desired temperature. The reported temperature characteristics may be used to make other types of decisions in other examples.

For illustrative purposes, embodiments will be discussed hereafter in the context of water heating systems. However, the principles of the present disclosure can be applied to other types of liquids and to liquid cooling systems as well. Indeed, using the techniques described herein, a liquid cooling system can be configured to estimate an amount of liquid below a predefined temperature threshold and to indicate the estimated amount to a user.

Figure 1:
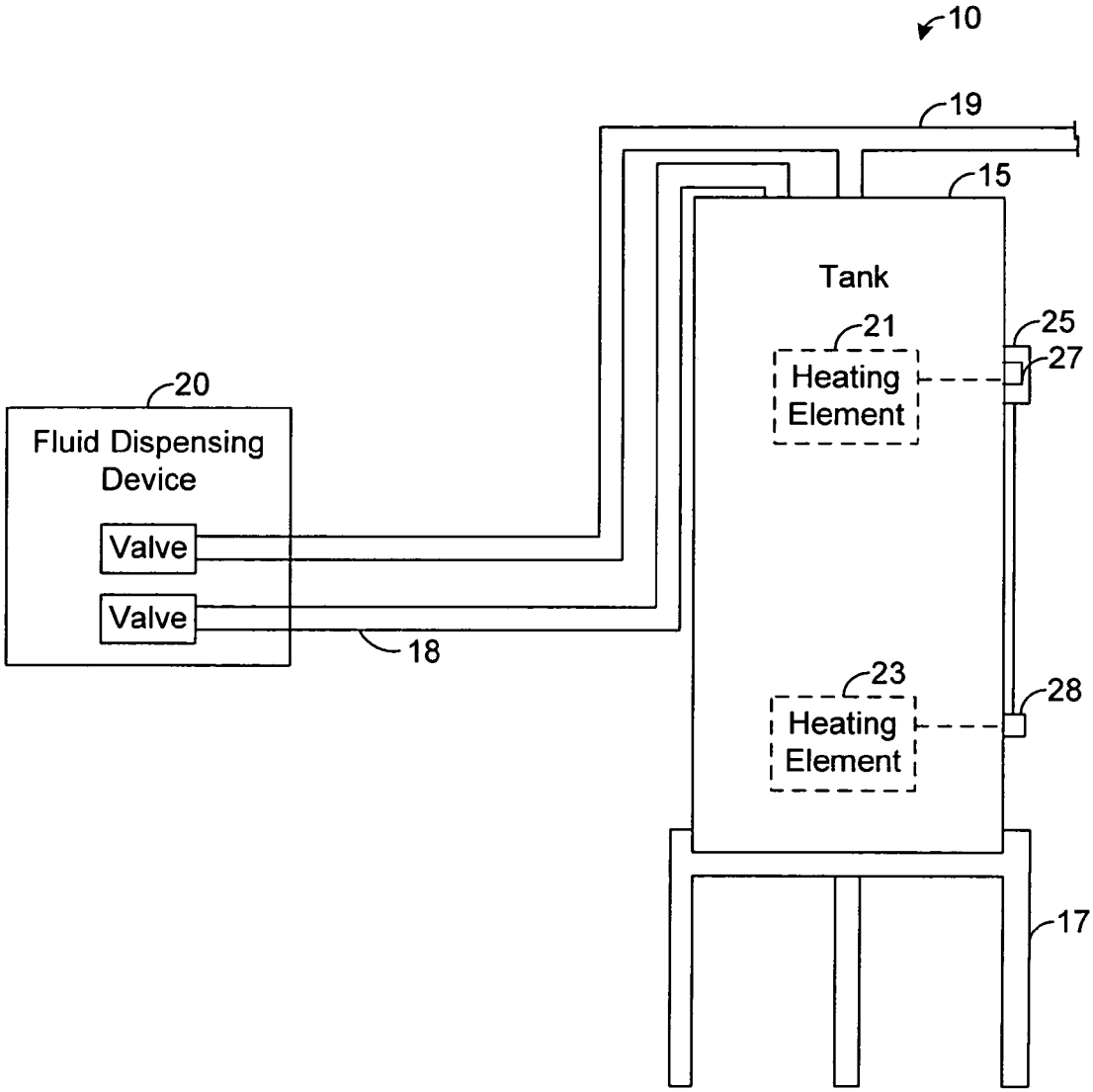
FIG. 1 is a block diagram illustrating an exemplary water heating system in accordance with the present disclosure.

FIG. 1 depicts an exemplary water heating system 10 comprising a tank 15 filled, at least partially, with water. In this regard, water may be drawn from the tank 15 via an outlet pipe 18 and dispensed via a dispensing device 20 coupled to the pipe 18. Further, the water drawn from the tank 15 may be replenished with water from an inlet pipe 19. Note that the water from inlet pipe 19 may be unheated and, therefore, decrease the average temperature of water within the tank 15 when introduced to the tank 15.

In the embodiment shown by FIG. 1, the tank 15 is resting on a stand 17, although such a stand 17 is unnecessary in other embodiments. Two heating elements, an upper heating element 21 and a lower heating element 23, are mounted on the tank 15 and submerged within the water of the tank 15. The heating elements 21 and 23 are selectively controlled by a controller 25 that activates and deactivates the heating elements 21 and 23 based on water temperature, as determined via a plurality of temperature sensors, which will be described below. In other examples, any number of heating elements may be employed to heat water within the tank 15.

In the exemplary embodiment of FIG. 1, the controller 25 comprises a first temperature sensor 27, such as a thermistor, mounted within a close proximity of the upper heating element 21, and the controller 25 controls the activation state of the upper heating element 21 based on this sensor 27. For example, if the temperature sensed by the sensor 27 falls below a first temperature threshold, referred to as a "lower set point," for the element 21, the controller 25 activates the heating element 21 such that it heats water within the tank 25. The heating element 21 remains activated until the temperature sensed by the sensor 27 exceeds a second temperature, referred to as an "upper set point," for the heating element 21. Once the controller 25 detects that the upper set point has been exceeded, the controller 25 deactivates the heating element 21.

The controller 25 controls operation of the lower heating element 23 in a similar manner based on another temperature sensor 28, which is mounted in a close proximity to the lower heating element 23. Like the upper heating element 21, the lower heating element 23 is correlated with an upper set point and a lower set point that may be respectively different than or, alternatively, match the upper set point and the lower set point for the upper heating element 21. If the temperature sensed by the sensor 28 falls below the lower set point for the element 23, the controller 25 activates the heating element 23 such that it heats water within the tank 25. The heating element 23 remains activated until the temperature sensed by the sensor 28 exceeds the upper set point for the heating element 23. Once the controller 25 detects that the upper set point has been exceeded, the controller 25 deactivates the heating element 23.

Thus, the upper and lower heating elements 21 and 23 are repetitively activated and deactivated in an attempt to maintain the temperatures sensed by the sensors 27 and 28 within a desired range. Various other techniques may be used to control the operation of the water heating system 10 and, in particular, the heating elements 21 and 23. Exemplary techniques for controlling components of the water heating system 10 are described in U.S. patent application Ser. No. 11/409,229, entitled "System and Method for Controlling Temperature of a Liquid Residing within a Tank," and filed on Apr. 21, 2006, which is incorporated herein by reference.

Figure 2:
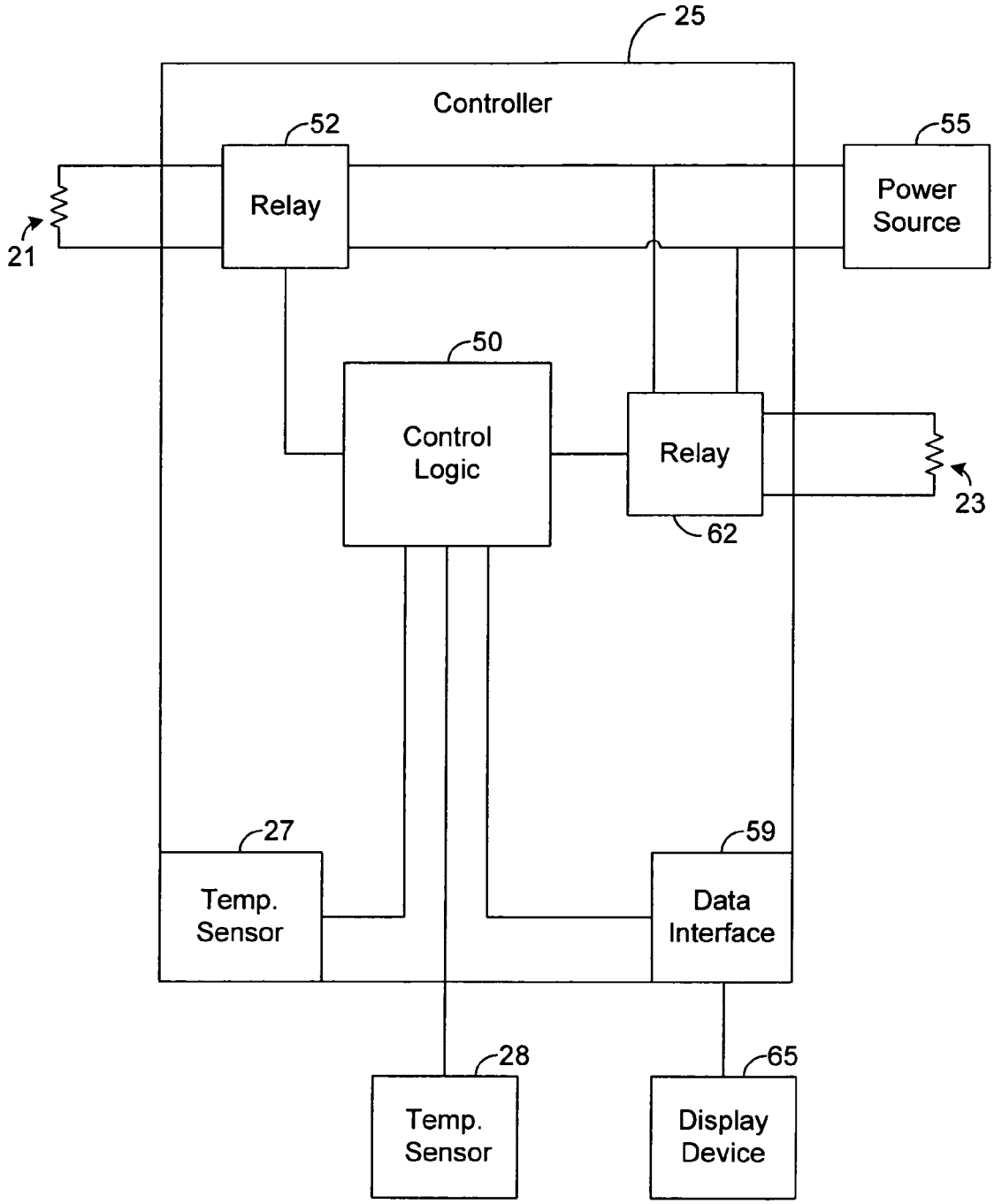
FIG. 2 is a block diagram illustrating an exemplary embodiment of a controller, such as is depicted in FIG. 1.

As shown by FIG. 2, the controller 25 has control logic 50, which may be implement in hardware, software, or a combination thereof. The controller 25 also has a relay 52 that is coupled to a power source 55, as well as the heating element 21. In one exemplary embodiment, the heating element 21 is a resistive device that generates heat when electrical current is passed through it. When the heating element 21 is to be activated, the control logic 50 closes the relay 52 such that electrical current from the power source 55 is passed through the heating element 21. When the heating element 21 is to be deactivated, the control logic 50 opens the relay 52 such that no current flows through it thereby preventing electrical current from passing through the heating element 21.

The controller 25 further has a relay 62 that is coupled to the power source 55, as well as the heating element 23. In one exemplary embodiment, the heating element 23 is a resistive device that generates heat when electrical current is passed through it. When the heating element 23 is to be activated, the control logic 50 closes the relay 62 such that electrical current from the power source 55 is passed through the heating element 23. When the heating element 23 is to be deactivated, the control logic 50 opens the relay 62 such that no current flows through it thereby preventing electrical current from passing through the heating element 23.

The control logic 50 is coupled to and receives temperature readings from the temperature sensors 27 and 28. The control logic 50 is also coupled to a data interface 59 that enables the control logic 50 to exchange information with a user. As an example, the interface 59 may comprise user input devices, such as a keypad, buttons, or switches, that enable a user to input data to the controller 25. The interface 59 may also comprise user output devices, such as a liquid crystal display (LCD) or other display device, light emitting diodes (LEDs), or other components known for outputting or conveying data to a user. The data interface 59 may also comprise communication devices, such as transceivers, that enable the controller 25 to communicate with external or remote devices.

In one exemplary embodiment, a display device 65, such as a liquid crystal display (LCD), external to the controller 25 communicates with the control logic 50 via the data interface 59. As an example, the display device 65 may be mounted on a side of the tank 15. In other examples, the display device 65 may be mounted elsewhere, such as in a bathroom where a user will take showers using water drawn from the tank 15. Various other locations of the display device 65 are possible.

The display device 65 may be coupled to the data interface 59 via one or more electrical connections to enable the display device 65 to communicate with the interface 59. In other embodiments, the display device 65 may receive data from the interface 59 wirelessly. In such an example, the data interface 59 may include a wireless transmitter (not shown), and the display device 65 may include a wireless receiver (not shown).

Figures 3, 5:
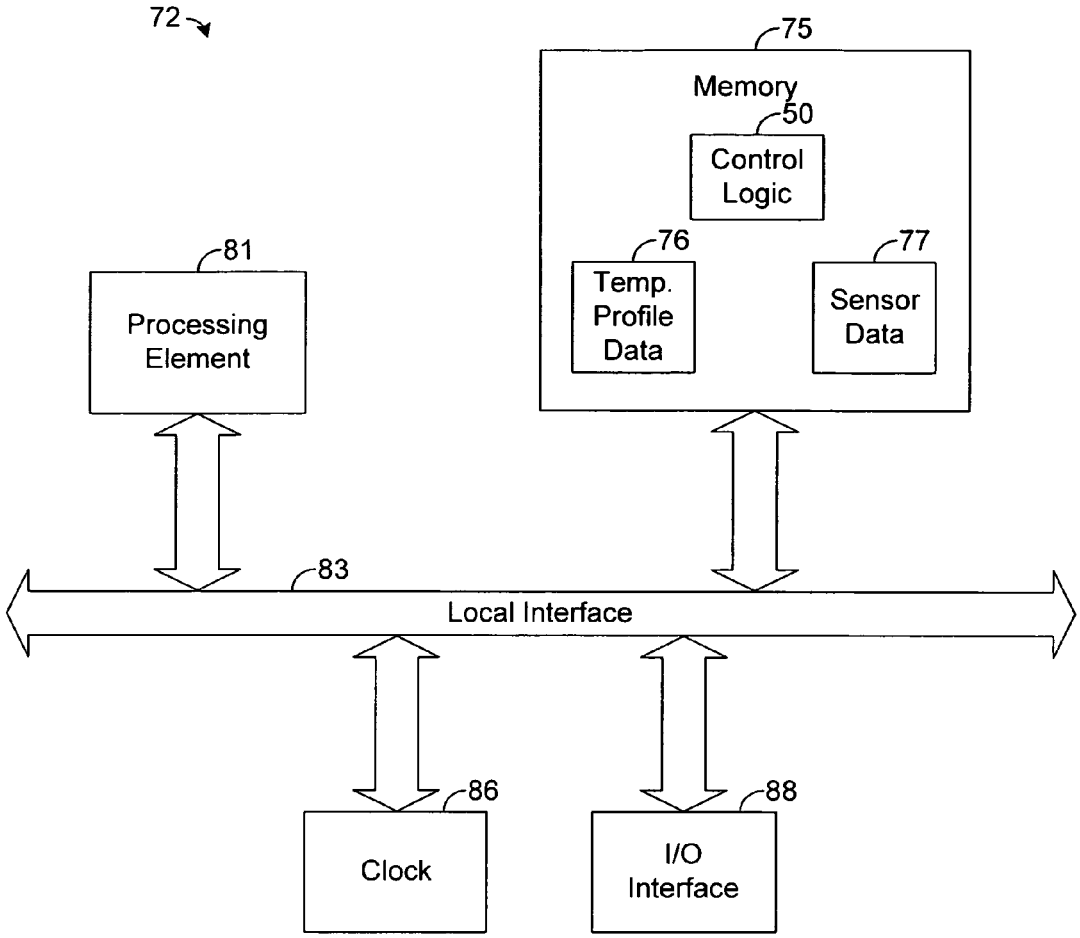
FIG. 3 is a block diagram illustrating an instruction execution device that may be used to execute control logic depicted in FIG. 2 when such control logic is implemented in software.
FIG. 5 illustrates exemplary entries of the temperature profile data.

In one exemplary embodiment, the control logic 50 is implemented in software and executed by an instruction execution apparatus, such as the apparatus 72 depicted in FIG. 3. In such an embodiment, the control logic 50 is stored in memory 75 along with temperature profile data 76 and sensor data 77, which will be described in more detail hereafter.

The exemplary embodiment of the instruction execution apparatus 72 depicted by FIG. 3 comprises at least one conventional processing element 81, such as a digital signal processor (DSP) or a central processing unit (CPU), that communicates to and drives the other elements within the apparatus 72 via a local interface 83, which can include at least one bus. As an example, the processing element 81 fetches and executes the instructions of the control logic 50. Furthermore, a clock 86 may be used to track time, as will be described in more detail hereafter, and an input/output (I/O) interface 88 enables the apparatus 72 to communicate with other components of the system 10. As an example, the I/O interface 88 may be coupled to and enable the control logic 50 to communicate with the temperature sensors 27 and 28, the relays 52 and 62, and the data interface 59.

As described above, the control logic 50 selectively controls the activation states of the heating elements 21 and 23 in an attempt to maintain the water of the tank 15 within a desired temperature range. Unfortunately, due to various factors, such as significant water usage within a relatively short duration, the heating elements 21 and 23 may be unable to keep the average temperature of the water within a desired range.

In one exemplary embodiment, the control logic 50 is configured to automatically estimate the total amount of hot water currently in the tank 15 and to report this amount to a user. As used herein, "hot water" refers to water above a predefined temperature threshold, and "the total amount of hot water currently in the tank 15" refers to the total amount of water currently in the tank 15 above the predefined temperature threshold.

Moreover, the water within the tank 15 often is not at a uniform temperature such that water in different areas of the tank 15 often has significantly different temperatures. Further, the temperature profile of the water in the tank 15 can vary drastically over time as water usage changes. Indeed, as water is drawn from the tank 15 and replenished, convection currents in the tank 15 can quickly disrupt the current temperature profile. Moreover, the current temperature readings of the temperature sensors 27 and 28 provide accurate real-time temperature information about the water in very close proximity of these sensors 27 and 28, but such temperature readings, by themselves, are not a very good predictor of the temperature of water that is not as close to the sensors 27 and 28. Thus, the current temperature readings, by themselves, are not very precise indicators of the total amount of hot water that is currently in the tank 15.

The estimated amount of hot water in the tank 15 can be expressed in a variety of ways. For example, the estimated volume of hot water may be reported. In such an example, the control logic 50 may report that x gallons of hot water are currently in the tank 15, where x can be any number from 0 to the total volume capacity of the tank 15 depending on the current temperature characteristics of the water in the tank 15. In another embodiment, the estimated amount of hot water may be expressed as a percentage of the overall volume capacity of the tank 15. For example, if x is the estimated volume of hot water currently in the tank 15 and if y is the total volume capacity of the tank 15, then the control logic 50 may report that the percentage of hot water in the tank is 100(x/y) %. As an example, if the total capacity of the tank 15 is 100 gallons and if the control logic 50 determines that the total amount of hot water currently in the tank 15 is 50 gallons, then the control logic 50 may report that the tank 15 is 50% full of hot water. Various other techniques for expressing the estimated amount of hot water in the tank 15 are possible in other embodiments.

Various methodologies may be employed to estimate the total amount of hot water currently in the tank 15. In one exemplary embodiment, control logic 50 estimates the total amount of hot water currently in the tank 15 based on the current readings of the temperature sensors 27 and 28, as well as at least one past reading from the temperature sensors 27 and 28.

In this regard, prior to the operation of the heating system 10, as described herein, the heating system 10 or another heating system similar to the system 10 is preferably tested to define the temperature profile data 76. Ideally, the tested heating system is configured identical to the system 10 depicted by FIG. 1 (which uses the temperature profile data 76 being defined by the tested heating system) but variations between the tested heating system and the system 10 of FIG. 1 are possible.

Figure 4:
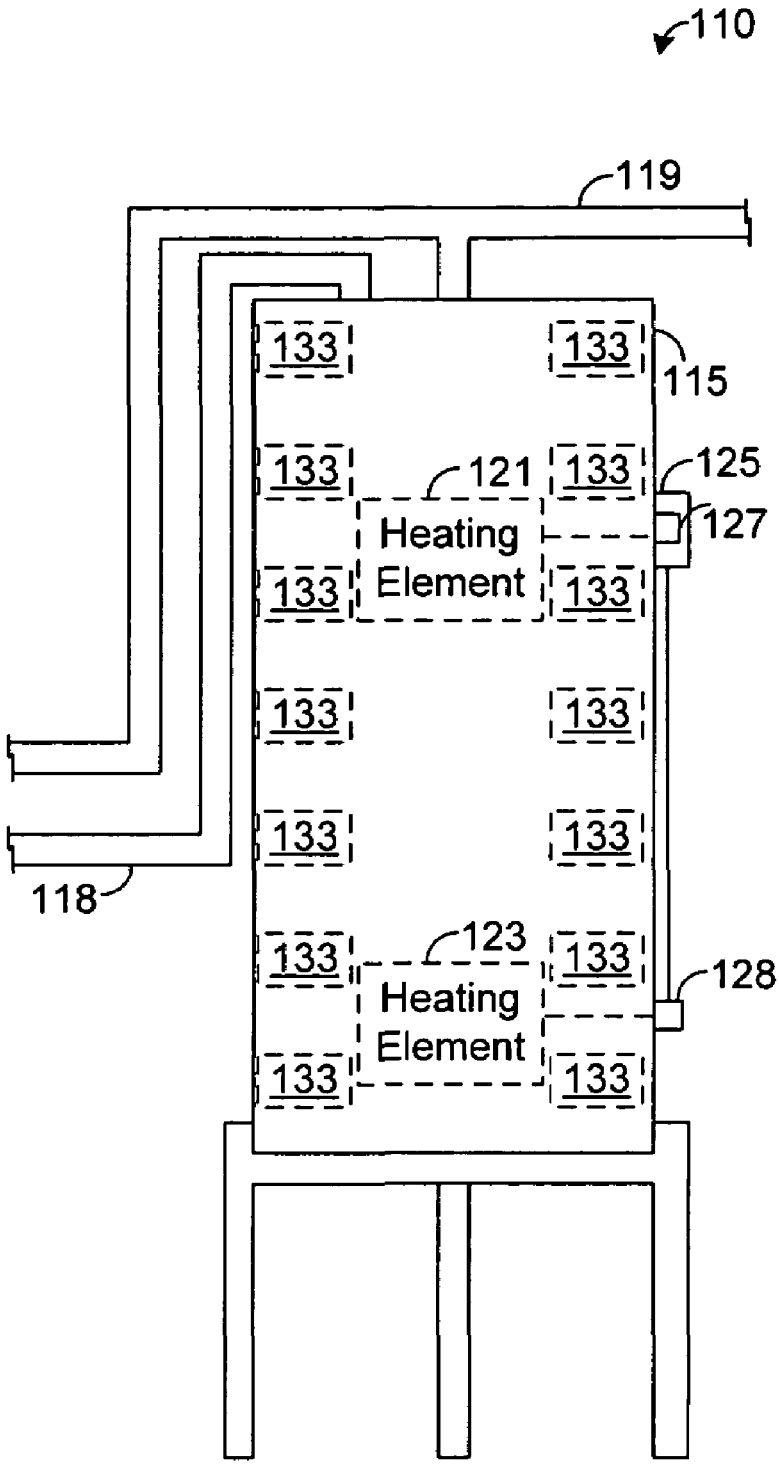
FIG. 4 is a block diagram of an exemplary water heating system that can be used to define temperature profile data used by the system of FIG. 1.

FIG. 4 depicts a tested heating system 110 in accordance with an exemplary embodiment of the present disclosure. The system 110 has a tank 115 and a controller 125 mounted on the tank 115, similar to the controller 25 and tank 15 of FIG. 1. Further, the system 110 has heating elements 121 and 123, similar to the heating elements 21 and 23 of FIG. 1, and the system 110 has temperature sensors 127 and 128 similar to the sensors 27 and 28 of FIG. 1. Unheated water is delivered to the tank 115 via pipe 119, and heated water is drawn from the tank 115 via pipe 118. The controller 125 controls the activation of the heating elements 121 and 123 based on sensors 127 and 128, respectively, in a similar manner that controller 25 controls heating elements 21 and 23 based on sensors 27 and 28, respectively.

However, the tested heating system 110 has a plurality of additional temperature sensors 133 mounted on the tank 115 and/or positioned at various locations in the tank 115. FIG. 4 shows various additional sensors 133 positioned within the tank 115. At any given time, the current readings from the additional temperature sensors 133 define a relatively detailed temperature profile of the water in the tank 15. As an example, concurrent temperature readings from the additional temperature sensor 133 may be captured to define a given temperature profile. In such a case, the temperature profile is essentially defined by a plurality of temperature readings, one from each additional sensor 133. By analyzing such a temperature profile, the total amount of hot water (i.e., water above a predefined temperature threshold) can be estimated by a user.

For example, if about half of the additional temperature sensors 133 measure a temperature above the predefined threshold, then it can be estimated that approximately half of the water within the tank 115 of the tested heating system 110 is above the predefined threshold. In such a case, it can be estimated that the total amount of hot water currently in the tank 115 of the tested system 110 is about 50% of the tank's total volume capacity. Thus, if the total volume capacity is 100 gallons, then it can be estimated that 50 gallons of hot water is in the tank 115.

Generally, the accuracy of the estimation is improved as the number of additional sensors 133 is increased. Indeed, hundreds or thousands of temperature sensors 133 can be positioned on or in the tank 15 to provide very detailed temperature profiles. Further, the accuracy can also be increased by evenly distributing the additional temperature sensors 133 throughout the tested system 110 such that the ratio of temperature sensors 133 detecting water above the specified temperature is likely an accurate estimate of the ratio of hot water to total water within the tank 115.

Moreover, as the tested system 110 operates, samples of the temperature profile of the water within the tank 115 can be recorded by controller 125, which is preferably in communication with each temperature sensor 127, 128, and 133. Each temperature profile sample can include the temperatures concurrently sensed by each temperature sensor 127, 128, and 133, the time that these readings were (i.e., the time that the profile sample was) taken, and the estimated amount of hot water within the tank 115 at this time.

The temperature profile data 76 of FIG. 3 is preferably defined based on the recorded temperature profiles for the tested system 110 described above. Thus, depending on the current readings of the temperature sensors 27 and 28, as well as various past temperature readings from these sensors 27 and 28, the control logic 50, by analyzing the temperature profile data 76, can determine an estimated amount of hot water within the tank 15.

There are various methodologies that can be used to define the data 76 and estimate an amount of hot water within the tank 15 base on the temperature profile data 76. In one exemplary embodiment, the temperature profile data 76 has a plurality of entries, as shown by FIG. 5. For simplicity, FIG. 5 shows four entries but any number of entries may be employed in other embodiments. Each entry includes a first temperature value ($T_{127}$) measured by sensor 127, a second temperature value ($T_{128}$) measured by sensor 128, a first rate of temperature change value ($\Delta T_{127}$) for sensor 127, a second rate of temperature change value ($\Delta T_{128}$) for sensor 128, and a value (E) indicating an estimated amount of hot water in the tank 115 at the approximate time that $T_{127}$ and $T_{128}$ of the same entry were measured. In the exemplary embodiment depicted by FIG. 5, the estimated amount of hot water is expressed as a percentage of the total volume capacity of the tank 115.

Each entry represents a respective sample of the temperature profile of the tested system 110. For example, as described above, the temperature profile of the tested system 110 can be sampled to determine the current reading of each temperature sensor 127, 128, and 133, the time that the sample was taken, and the estimated of hot water within the tank 115 of the tested system 110 at the time of the sample. This information for a given sample may be used to define an entry in the data 76.

For example, $T_{127}$ and $T_{128}$ may be assigned the concurrent temperatures measured by the sensors 127 and 128, respectively, for a given sample, referred to as the "current sample." Further, E may be assigned the estimated amount of hot water within the tank 115 for the current sample. As described above, E may be determined based on the ratio of sensors 133 that detect a temperature above a predefined threshold, such as 105 degrees Fahrenheit, for the current sample. In addition, $\Delta T_{127}$ represents the rate of temperature change of the sensor 127 at the time of the current sample, and $\Delta T_{128}$ represents the rate of temperature change of the sensor 128 at the time of the current sample. Thus, $\Delta T_{127}$ may be calculated by subtracting $T_{127}$ from the temperature reading of sensor 127 for another sample that occurred a predefined amount of time (e.g., 1 minute) prior to the current sample, and $\Delta T_{128}$ may be calculated by subtracting $T_{128}$ from the temperature reading of sensor 28 for the other sample that occurred the predefined amount of time prior to the current sample.

Moreover, multiple temperature profile samples are taken over time. The temperature values measured for each profile sample can be similarly used to determine the values of a different entry in the data 76, such that each entry essentially represents a different profile sample of the tested system 110. Once the temperature profile data 76 is defined, as described herein, the data 76 may be stored in the controller 25 and then used to estimate the amount of hot water within the tank 15.

In this regard, it is assumed that the temperature characteristics of the tank 15 are similar to the temperature characteristics of the tank 115, particularly if the tanks 15 and 115 are similarly configured. Thus, during operation, the control logic 50 determines which entry of the temperature profile data 76 most closely resembles the current temperature characteristics of the water in the tank 15, as determined via the current temperature readings and the current rates of temperature change sensed by the sensors 27 and 28. The control logic 50 then uses the estimated value (E) of this entry as the estimated amount of hot water in the tank 15.

Various techniques may be employed to achieve the foregoing. In one exemplary embodiment, the control logic 50 periodically receives the current temperature readings of sensors 27 and 28. Upon receiving a set of current temperature readings, the control logic 50 calculates the rates of temperature change currently measured by these sensors 27 and 28. In this regard, the control logic 50 may subtract the current temperature reading from sensor 27 from a previous temperature reading from sensor 27 (e.g., a temperature reading measured approximately 1 minute prior to the current reading) to determine the rate of temperature change for the sensor 27. In addition, the control logic 50 may subtract the current temperature reading from sensor 28 from a previous temperature reading from sensor 28 (e.g., a temperature reading measured 1 minute prior to the current reading). The control logic 50 may then compare the current temperature readings and rates of temperature change to the temperature profile data 76 to identify the entry in the data 76 best matching the current temperature readings and rates of temperature change.

For example, in determining how closely an entry resembles the current temperature characteristics of the water in the tank 15, the control logic 50 preferably compares the current temperature of sensor 27 to $T_{127}$ of the entry, the current temperature of sensor 28 to $T_{128}$ of the entry, the current rate of temperature change of sensor 27 to $\Delta T_{127}$ of the entry, and the current rate of temperature change of sensor 28 to $\Delta T_{128}$ of the entry. Thus, if $T_{127}$, $T_{128}$, $\Delta T_{127}$, and $\Delta T_{128}$ of an entry exactly match the current temperature of sensor 27, the current temperature of sensor 28, the current rate of temperature change for sensor 27, and the current rate of temperature change for sensor 28, respectively, then the control logic 50 may identify this entry as the best matching. If there is not an exact match, then the control logic 50 may identify another entry that most closely resembles the current temperatures and rates of temperature change for sensors 27 and 28.

There are many techniques that may be used to determine which entry most closely resembles the current temperature characteristics of the water within the tank 15. In one embodiment, the control logic 50 may simply sum the differences of the compared values, and the entry producing the lowest sum may be identified as the best matching entry. It is possible for the comparisons to be weighted. For example, similarity in the rate of temperature change may be used as a more significant factor, as compared to similarity in current temperatures, in determining the best matching entry. Various other techniques for selecting the best matching entry are possible.

After identifying the best matching entry, the control logic 50 retrieves E (i.e., the value indicative of the estimated amount of hot water) from this entry and uses the retrieved value as the estimated amount of hot water currently in the tank 15. Thus, the control logic 50 reports this retrieved value to the user. For example, the control logic 50 may transmit the value to the display device 65, which displays the value to the user. Since the estimated amount of hot water was determined for the tested system 110 when the tested system 110 had similar temperature characteristics, as detected by sensors 27 and 28, relative to the current temperature characteristics of system 10, it can be assumed that the estimated amount of hot water reported to the user is an accurate estimate of the actual amount of hot water currently in the tank 15.

Thus, the user may make an informed decision about how to use the water within the tank 15. For example, if the reported value indicates that there is very little hot water within the tank 15, the user may elect to postpone taking a shower that uses water drawn from the tank 15. Other types of decisions may be performed in other examples.

Note that the estimated amount of hot water may be adjusted based on various factors. For example, different tanks 15 have different heat loss characteristics depending on the insulation properties of the tank, location of the tank, and various other factors. The control logic 50 may be configured to monitor the operation of the system 10 and, in particular, the temperature sensors 27 and 28 to determine the heat loss characteristics of the tank 15 and to then appropriately adjust the estimation of the amount of hot water in the tank 15. U.S. patent application Ser. No. 11/409,229 describes exemplary techniques for monitoring operation of water heating systems. For example, the control logic 50 may identify time periods, referred to as "idle time periods" in which significant amounts of water are not be drawn from the tank 15. If the rate of temperature change, as detected by sensors 27 and 28, during an idle time period is relatively high, then it is likely that the tank 15 is experiencing a high amount of heat loss.

Moreover, the temperature characteristics may be monitored over time to determine time periods when a high amount of heat loss is likely. For example, it may be determined that high amounts of heat loss occur during nighttime hours or during Winter months.

If it is determined that the tank 15 experiences a relatively high amount of heat loss during a particular time period (e.g., during Winter or at night), then the control logic 50 may be configured to slightly decrease each estimation of the amount of hot water in the tank 15 during the particular time period. In another example, the estimated amount of hot water may be increased if it is determined that the tank 15 is experiencing a relatively low amount of heat loss.

An exemplary use and operation of the system 10 will not be described with reference to FIG. 6.

For illustrative purposes, assume that the temperature profile data 76 is defined, as described above, with a plurality of entries as shown in FIG. 4. Also assume that a user is about to take a shower and that the display device 65 is located remote from the tank 15 in a bathroom containing the shower.

Figure 6:
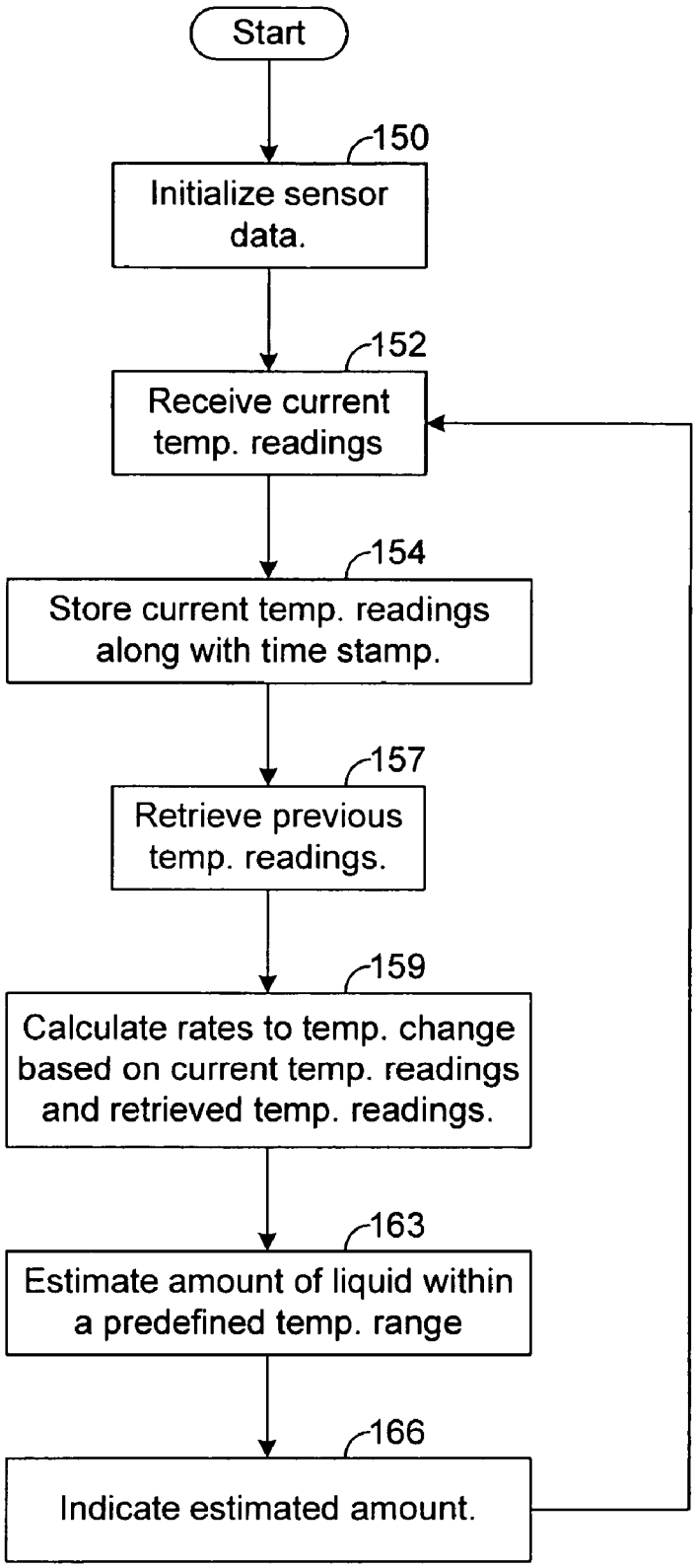
FIG. 6 is a flow chart illustrating an exemplary methodology for indicating an estimated amount of hot water in the system depicted by FIG. 1.

As shown by block 150 of FIG. 6, the sensor data 77 is initialized. In this regard, the control logic 50 periodically receives and stores, in memory 75 (FIG. 3), the temperature readings from sensors 27 and 28. Along with each concurrently received set of temperature readings from sensors 27 and 28, the control logic 50 also stores a time stamp indicating the time that these concurrent temperature readings are received. Thus, the sensor data 77 essentially defines a history of temperature readings from sensors 27 and 28, and the sensor data 77 can be analyzed to determine the temperatures sensed by either of the sensors 27 and 28 at any given time in recent history. Note that the time stamps are preferably generated by the clock 86 (FIG. 3).

As shown by block 152, the control logic 50 receives the current temperature readings of sensors 27 and 28. As shown by block 154, the control logic 50 stores the current readings in memory 75 as additional sensor data 77, along with the time stamp indicating the time that the current readings were received. The time stamp is preferably generated by clock 86.

The control logic 50 then analyzes the sensor data 77 to locate the temperature readings that were received by the controller 25 at a time, t, prior to the current temperature readings. For example, the control logic 50 may locate the temperature readings correlated with the time stamp that occurred approximately one minute prior to the time stamp of the current temperature readings. In such an example, the located temperature readings should have been measured by the sensors 27 and 28 approximately one minute prior to the current temperature readings. In other examples, other time intervals are possible.

As shown by block 157, the control logic 50 retrieves the located temperature readings, and the control logic 50 calculates a rate of temperature change for each of the sensors 27 and 28 based on the current temperature readings and the retrieved temperature readings, as indicated by block 159. In this regard, the control logic 50 calculates a rate of temperature change for sensor 27 by subtracting the current temperature reading from sensor 27 with the retrieved temperature reading from sensor 27. Further, the control logic 50 calculates a rate of temperature change for sensor 28 by subtracting the current temperature reading from sensor 28 from the retrieved temperature reading from sensor 28.

The control logic 50 then estimates an amount of hot water (i.e., an amount of water above a predefined temperature threshold) in the tank 15 based on the current temperature readings and the calculated rates of temperature change, as indicated by block 163. For example, according to the techniques described herein, the control logic 50 may compare the foregoing values to the temperature profile data 76 to locate the entry that most closely matches, as determined by the control logic 50, the current temperature readings and the values calculated in block 159. The control logic 50 may then retrieve the estimated value (E) stored in this identified entry, and use this value as an estimate of the amount of hot water currently in the tank 15. Other techniques for estimating the amount of hot water in the tank 15 are possible in other examples.

As shown by block 166, the control logic 50 reports the estimated value to a user. In the instant example, the control logic 50 transmits the estimated value to the display device 65, which displays the value to the user. If the output of display device 65 indicates that the estimated amount of hot water is relatively low, the user may decide to postpone the shower until the estimated amount of hot water has increased. If the output of the display device 65 indicates that the estimated amount of hot water is relatively high, then the user may decide to take a shower immediately. Accordingly, as illustrated by the instant example, the system 10 is able to automatically warn users when there may be an insufficient amount of hot water within the tank 15 to achieve a desired purpose.

Note that different size tanks may have similar temperature characteristics. Therefore, it is possible that the temperature profile data 76 defined from the tested system 110 may be used by the system 10 even if the size of tank 15 is different than the size of tank 115. Thus, it is possible that multiple tests to generate the data 176 would not be necessary to accommodate different tank sizes. Moreover, expressing the estimated amount of hot water as a percentage of tank volume has the advantage of not requiring recalibration of the data 176 for different tank sizes.

Now, therefore, the following is claimed:

1. A water heating system, comprising:

a tank;

a heating element mounted on the tank;

a temperature sensor positioned to sense a temperature of water within the tank; and logic configured to estimate, based on a current temperature reading from the temperature sensor and at least one previous temperature reading, an amount of water currently within the tank that is within a redefined temperature range, the logic further configured to provide an indication of the estimated amount; and a display device, wherein the logic is configured to provide the indication by causing the display device to display a message indicative of the estimated amount.

2. The system of claim 1, wherein the logic is configured to calculate a rate of temperature change based on the current temperature reading and the previous temperature reading and to estimate, based on the calculated rate of temperature change, the amount of water currently within the tank that is within the predefined temperature range.

3. The system of claim 1, wherein the logic is configured to control an activation state of the heating element based on the current temperature reading.

4. The system of claim 1, wherein the logic is configured to record a history of temperature readings from the temperature sensor and to estimate, based on the history of temperature readings, the amount of water currently within the tank that is within the predefined temperature range.

5. The system of claim 1, wherein the logic is configured to store temperature profile data and to estimate, based on the temperature profile data, the amount of water currently within the tank that is within the predefined temperature range.

6. The system of claim 5, wherein the temperature profile data is determined by sampling, via a plurality of temperature sensors, a temperature profile of water within a second tank prior to the logic estimating the amount of water currently within the tank that is within the predefined temperature range.

7. The system of claim 1, wherein the display device is located remotely from the tank.

8. A water heating system, comprising:

a tank;

a heating element mounted on the tank;

at least one temperature sensor positioned to sense a temperature of water within the tank;

a display device; and logic configured to calculate, based on the at least one temperature sensor, a rate of temperature change of water within the tank, the logic further configured to estimate, based on the calculated rate of temperature change, an amount of water currently within the tank that is within a predefined temperature range, the logic further configured to provide an indication of the estimated amount by causing the display device to display the indication.

9. The system of claim 8, wherein the logic is configured to record a history of temperature readings from the at least one temperature sensor and to estimate, based on the history of temperature readings, the amount of water currently within the tank that is within the predefined temperature range.

10. The system of claim 8, wherein the logic is configured to store temperature profile data and to estimate, based on the temperature profile data, the amount of water currently within a tank that is within the predefined temperature range.

11. The system of claim 10, wherein the temperature profile data is determined by sampling, via a plurality of temperature sensors, a temperature profile of water within a second tank prior to the logic estimating the amount of water currently within a tank that is within the predefined temperature range.

12. A method, comprising the steps of:

controlling a temperature of water residing within a tank via a heating element mounted on the tank;

sensing a first temperature of the water;

sensing a second temperature of the water subsequent to the sensing the first temperature step; and estimating, based on the first and second temperatures, an amount of water currently within the tank that is within a predefined temperature range; and indicating the estimated amount.

13. The method of claim 12, further comprising the step of calculating a rate of temperature change based on the first and second temperatures, wherein the estimating step is based on the calculated rate of temperature change.

14. The method of claim 12, wherein the controlling step is based on the first temperature.

15. The method of claim 12, further comprising the step of sampling a temperature profile of water within a second tank via a plurality of temperature sensors, wherein the estimating step is based on the sampling step.

* * * * *

UNITED STATES PATENT AND TRADEMARK OFFICE

CERTIFICATE OF CORRECTION

PATENT NO. : 7,574,120 B2
APPLICATION NO. : 11/432103
DATED : August 11, 2009
INVENTOR(S) : Patterson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 486 days.

Signed and Sealed this

Seventh Day of September, 2010

David J. Kappos

David J. Kappos
*Director of the United States Patent and Trademark Office*